United States Patent [19]

Tomczak

[11] Patent Number: 4,525,875

[45] Date of Patent: Jul. 2, 1985

[54] CHEST PROTECTOR WITH RIGID PLATES

[75] Inventor: Walter F. Tomczak, Fond du Lac, Wis.

[73] Assignee: MacGregor Sporting Goods, Inc., East Rutherford, N.J.

[21] Appl. No.: 514,324

[22] Filed: Jul. 15, 1983

[51] Int. Cl.[3] ..... A41D 13/00

[52] U.S. Cl. ..... 2/2; 2/2.5

[58] Field of Search ..... 2/2, 2.5, 24

[56] References Cited

U.S. PATENT DOCUMENTS 2,756,429 7/1956 Malachowski ..... 2/2

3,500,472 3/1970 Castellani ..... 2/2

*Primary Examiner*—Doris L. Troutman

*Attorney, Agent, or Firm*—Hopgood, Calimafde, Kalil, Blaustein & Judlowe

[57] ABSTRACT

An improved chest protector including additional protection to the sternum area of an athlete's chest. The additional protection is provided by relatively rigid plates bonded to the conventional shock-absorbing chest protector material on the side opposite the wearer's body and directly over the sternum area. The plates distribute the impact from a high speed object over a relatively large area of the shock-absorbing material, thus allowing the chest protector to absorb more of the object's energy than is possible with prior chest protectors.

9 Claims, 7 Drawing Figures

CHEST PROTECTOR WITH RIGID PLATES

BACKGROUND OF THE INVENTION

1. Field of the Invention

This invention pertains to protective clothing, and more particularly to clothing worn by participants in sporting events to protect against chest injuries.

2. Description of the Prior Art

The chest area of most athletes is normally unprotected against impacts. If an object strikes a player's chest, the force can be sufficient to cause trauma to either the heart muscle directly or to the vagus nerve, which has control over the heart and lungs (among other organs).

A child is more vulnerable to chest trauma than an adult. A child's sternum or breastbone is more compliant than an adult's. Thus, it is more easily compressed when struck, increasing the danger of cardiac injury. A relatively weak impact against a child's chest can compress the sternum against the heart, which may then be pressed against the spinal column, causing contusions, lacerations, or rupture of the heart. These internal injuries can occur without any external evidence of injury and without rib fracture. The lack of external signs make cardiac contusions difficult to diagnose. Since the pericardial cavity of a child is relatively small, only a slight injury and internal bleeding can cause severe problems. In addition, children often can only poorly describe their symptoms.

Baseball "catchers" and umpires are particularly exposed to chest injury from pitched and batted balls. The magnitude of the problem, particularly as it relates to young athletes, was discussed in a government publication. In December 1981, the U.S. Consumer Product Safety Commission, Division of Hazard Analysis and Division of Human Factors, issued a report entitled "Overview of Sports-Related Injuries to Persons 5–14 Years of Age". The report focused on injuries to participants in fifteen selected sports activities. An important conclusion was that the most frequent source of fatalities among children aged 5 to 14 was from the children being struck by a ball or puck. Specifically, during the eight year period from 1973 through 1980, twenty-two deaths occurred due to direct blows to the chest. Seventeen of the deaths were caused by baseballs, and the fatalities occurred at every age within the 5 to 14 age group. Further, of the twenty-two chest-related fatalities, seventeen reports of death specifically mentioned arrhythmias or cardial arrest, possibly due to direct trauma to either the heart or the vagus nerve or both. Most victims died within the hour following impact.

Because of the potential injuries, baseball catchers and umpires invariably wear chest protectors of some type. The typical chest protector covers the torso from the neck to the crotch. State of the art chest protectors utilize light-weight resilient shock-absorbing synthetic foam to cushion the impact of the high speed baseball. The protective layer of foam may be grooved both horizontally and vertically to allow maximum flexibility. While the foam absorbs impact very well, it is not able to distribute the impact over an area larger than the area of the ball. Thus, if the ball strikes the player in the sternum, the unabsorbed energy will be transmitted to a relatively small area of the vulnerable sternum. As mentioned, this is particularly hazardous in the case of children.

Accordingly, a need exists for a chest protector that provides increased protection to the sternum area while maintaining the flexibility, light weight, and shock-absorbing characteristics of present protectors.

SUMMARY OF THE INVENTION

In accordance with the present invention, a chest protector is provided that has improved capabilities for protecting the sternum area of the wearer, particularly a child. This is accomplished by apparatus which includes one or more impact-resistant plates that cover the wearer's sternum area. The plates are permanently fastened to the resilient shock-absorbing foam padding of conventional chest protectors on the side opposite the wearer's body.

The plates supply an additional buffer to the impact of a high speed ball striking the chest protector. The additional buffer is produced because the plates enable the ball's energy to be distributed over a larger area than is possible using only the conventional foam material. Without the plate, the foam compresses, and thus absorbs energy, only in the region directly contacted by the ball. In contrast, with a sternum plate, the foam compresses under the entire area of the plate, thus utilizing additional foam for energy absorption. In addition, any unabsorbed energy is transmitted to the wearer over a larger portion of the sternum and even onto the adjoining ribs. This reduces the possibility of a serious chest injury.

Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
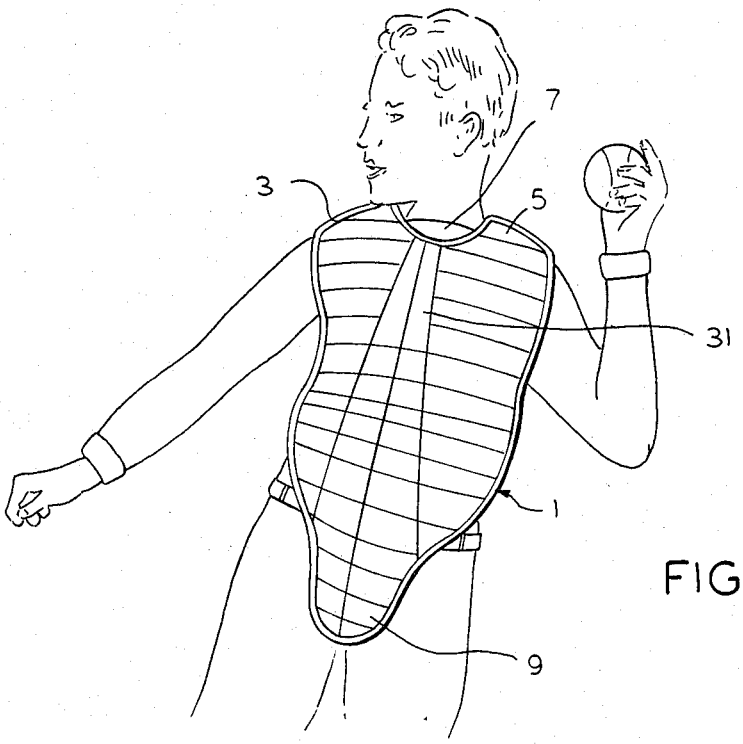
FIG. 1 is a pictorial view of an athlete wearing the chest protector of the present invention.
Figure 2:
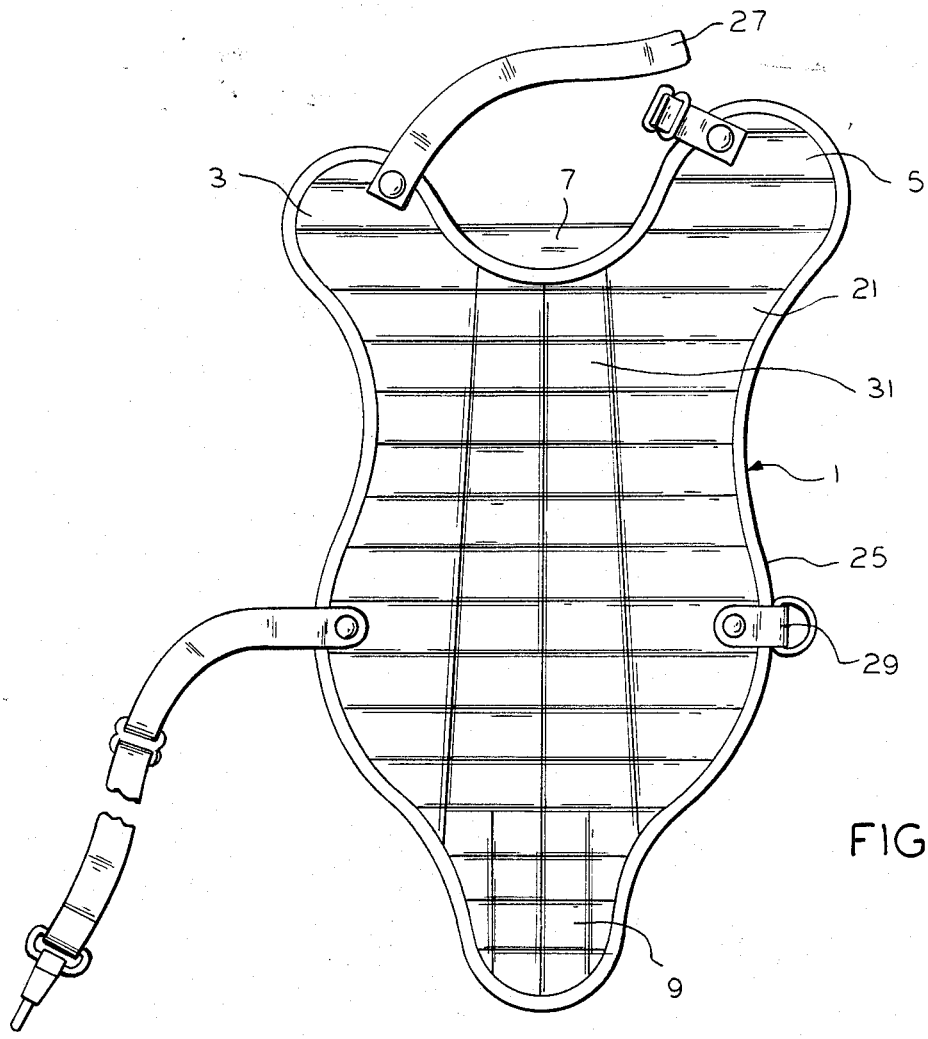
FIG. 2 is a front view of a chest protector incorporating the present invention.
Figure 3:
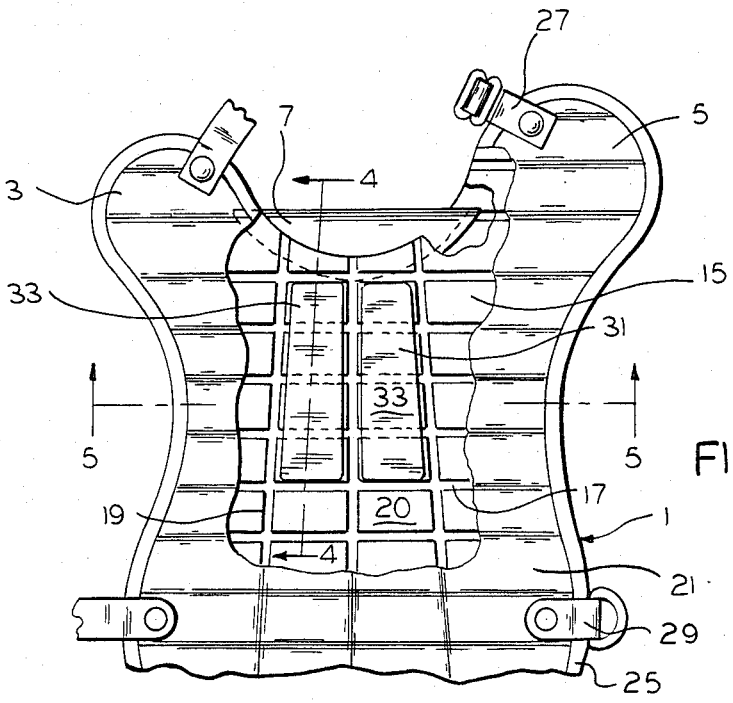
FIG. 3 is a partial front view of a chest protector incorporating the present invention, with the front covering partially cut away.

Referring to FIGS. 1–3, a chest protector 1 is illustrated which includes the present invention. The chest protector is particularly beneficial to youthful participants in baseball games who are exposed to potentially harmful blows to the sternum from thrown and batted balls.

The chest protector 1 is generally shaped to protect the front side of the wearer's torso from the neck to the crotch. The chest protector is formed with a pair of upwardly extending lobes 3, 5, which may be of unequal size, for protecting the wearer's shoulders. Extending between the lobes 3, 5 is a throat pad 7. The lower end of the chest protector tapers into a crotch-protecting region 9.

Figure 5:
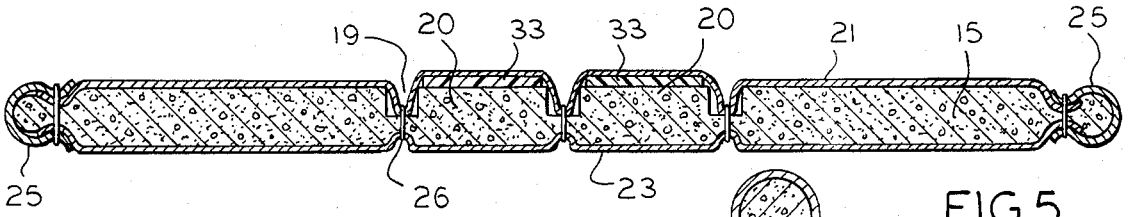
FIG. 5 is a sectional view taken along lines 5—5 of FIG. 3.
Figure 4:
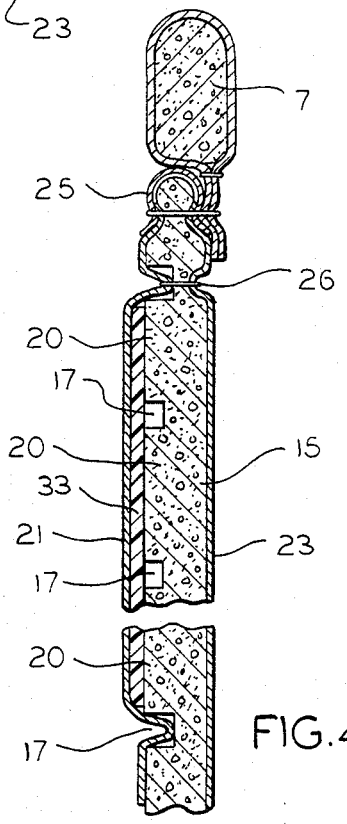
FIG. 4 is a sectional view taken along lines 4—4 of FIG. 3.

The inner pad 15 of the chest protector 1 is manufactured from a light-weight resilient shock-absorbing foam material, FIGS. 3–5. A preferred thickness of the foam is about 0.63 inches. To provide flexibility to the chest protector, the surface of the inner pad 15 opposite the wearer's body may be formed with a series of horizontal grooves 17 and vertical grooves 19, thus creating a multiplicity of resilient cushions 20. The horizontal and vertical flex grooves may be about 0.18 inches and 0.25 inches wide, respectively. Both sets of grooves may be about 0.25 inches deep. A typical dimension between horizontal grooves is about 1.25 inches.

The front and back sides of the inner pad are normally covered by a front covering 21 and a back covering 23, both preferably made of a durable nylon material. To neatly and permanently join the front and back coverings and inner pad into a unitary structure, an edge binding 25 of nylon or vinyl is sewn to the periphery of the chest protector. The front and back coverings may also be sewn together through the inner pad along the horizontal and vertical grooves 17, 19, respectively, as represented by reference numeral 26. The throat pad 7 is also preferably constructed of vinyl covered foam. Reference numerals 27 and 29 indicate standard neck and back straps, respectively.

In accordance with the present invention, the portion 31 of the chest protector 1 that covers a wearer's sternum area is provided with enhanced protective means, FIGS. 1–3. In the preferred embodiment, the additional protective means includes a pair of side-by-side vertically oriented rectangular plates 33, FIG. 3. Each sternum plate spans and is permanently attached to the surfaces of several resilient cushions 20 in the sternum area 31. The preferred attachment method is adhesive bonding, as, for example, with an epoxy adhesive. The sternum plates are proportioned to suit the particular size chest protector. For example, in a size suitable for a small child, each plate is about 1.50 inches wide and 5 inches long, but these dimensions are not considered critical. A typical thickness is about 0.06 inches.

The sternum plates 33 are preferably made of a high density polyethylene plastic. This material is light weight, and it possesses high impact strength. Although somewhat flexible so as not to greatly impair overall flexibility of the chest protector 1, the plates are sufficiently rigid in bending so as to greatly diminish the impact on a wearer's chest from a high speed ball, as will now be explained.

Figure 6:
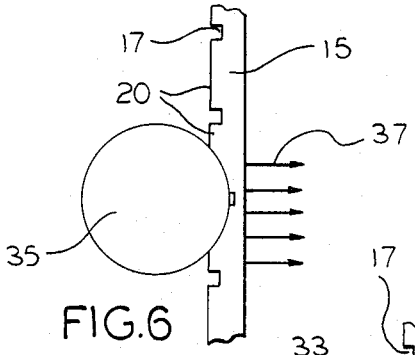
FIG. 6 is a schematic view showing the distribution and transmission of unabsorbed energy produced by a baseball striking the foam portion of a chest protector.

FIG. 6 shows the behavior of a chest protector shock-absorbing foam under the impact of a high speed baseball. The foam under the surface area in contact with the ball deforms under the force of the ball, thus absorbing a portion of the ball's energy. The portion of the ball's energy not absorbed by the foam is transmitted to the wearer's body, as indicated by arrows 37. The energy is transmitted over an area only slightly larger than the projected area of the ball in contact with the foam.

Figure 7:
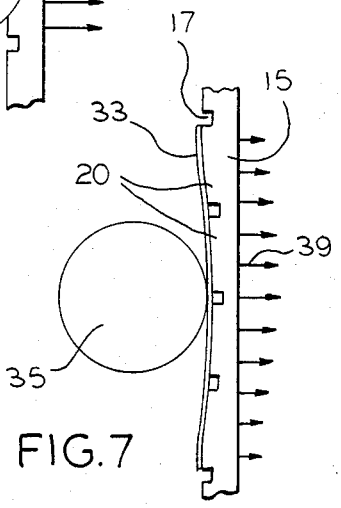
FIG. 7 is a schematic view showing the distribution and transmission of unabsorbed energy produced by a baseball striking a sternum plate of the improved chest protector of the present invention.

FIG. 7 shows the behavior of the improved chest protector of the present invention under the impact of a high speed baseball striking a sternum plate 33. The plate, being relatively stiff in bending, bends only a minimal amount at the point of contact with the ball. Because of the plate's stiffness, it distributes the impact force to all of the cushions 20 to which it is bonded. This greatly increases the volume of the shock-absorbing foam that may be utilized to absorb the ball's energy. As a result, the energy transmitted to the wearer's body is less than without the plate. Moreover, the unabsorbed energy is spread more diffusely over the sternum and adjoining ribs. Thus, the risk of injury to the internal organs of the chest is greatly reduced.

It is apparent that there has been provided, in accordance with the invention, an improved chest protector that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An improved chest protector having a flexible pad of shock-absorbing material for protecting the torso of a wearer, said pad defining a plurality of distinct cushions, wherein the improvement comprises:

means for providing increased protection to the sternum area of the wearer, said protection means including at least one sternum plate attached to at least two cushions of said flexible pad on the side opposite the wearer's body and directly over the wearer's sternum.

2. The improved chest protector of claim 1 wherein two spaced sternum plates are attached to at least two cushions of said flexible pad.

3. The improved chest protector of claim 2 wherein the sternum plates are vertically oriented and are positioned side-by-side.

4. The improved chest protector of claim 3 wherein the sternum plate is formed of a thin strip of high density polyethylene plastic, and wherein the plate is adhesively bonded to the flexible pad.

5. A chest protector for protecting the torso of a wearer comprising:

(a) a flexible front covering;

(b) a flexible back covering adapted to be worn adjacent said torso of said wearer;

(c) a flexible inner pad provided with a plurality of substantially horizontal and substantially vertical grooves defining a plurality of cushions;

(d) binding means for binding the coverings and flexible pad into a unitary structure, said cushions being adjacent said front covering; and (e) shield means for protecting the sternum area of said wearer, said shield means including two side by side plates, each of said plates being secured to at least two of said cushions, the length of the cushions to which said plates are secured being defined by identical substantially vertical grooves of said flexible pad.

6. The chest protector of claim 5, wherein said plates are formed of plastic and are adhesively secured to said cushions.

7. The chest protector of claim 6, wherein said plates are substantially vertically oriented and the width of said plates is smaller than the distance between said identical substantially vertical grooves which define the length of the cushions to which said plates are secured.

8. The chest protector of claim 7, wherein said substantially vertical grooves are about 0.18 inches wide and about 0.25 inches deep and said substantially horizontal grooves are about 0.25 inches wide and about 0.25 inches deep, said substantially horizontal grooves being spaced approximately 1.25 inches apart.

9. The chest protector of claim 6, wherein said plastic is high density polyethylene plastic and said adhesive is epoxy.

* * * * *